US006823821B2

(12) United States Patent
Kayahara et al.

(10) Patent No.: US 6,823,821 B2
(45) Date of Patent: Nov. 30, 2004

(54) COMBUSTION METHOD AND APPARATUS FOR $NO_X$ REDUCTION

(75) Inventors: Toshihiro Kayahara, Matsuyama (JP); Kazuhiro Tachino, Matsuyama (JP); Noboru Takubo, Matsuyama (JP); Kenji Matunari, Matsuyama (JP); Kyosuke Okubo, Matsuyama (JP)

(73) Assignee: Miura Co., Ltd., Matsuyama (JP)

( * ) Notice: Subject to any disclaimer, the term of this patent is extended or adjusted under 35 U.S.C. 154(b) by 0 days.

(21) Appl. No.: 10/730,092

(22) Filed: Dec. 9, 2003

(65) Prior Publication Data

US 2004/0115575 A1 Jun. 17, 2004

(30) Foreign Application Priority Data

Dec. 16, 2002 (JP) ..... 2002-363627

(51) Int. Cl.[7] ..... F22B 23/06

(52) U.S. Cl. ..... 122/367.1; 122/235.11; 110/234

(58) Field of Search ..... 122/367.1, 367.2, 122/78, 235.11, 235.13, 235.22, 479.2; 110/234

(56) References Cited

U.S. PATENT DOCUMENTS

| | | | | |
|---|---|---|---|---|
| 4,995,807 A | * | 2/1991 | Rampley et al. | 431/9 |
| 5,040,470 A | * | 8/1991 | Lofton et al. | 110/234 |
| 5,611,299 A | * | 3/1997 | Varga et al. | 122/498 |
| 5,791,299 A | * | 8/1998 | Matsuo et al. | 122/367.1 |
| 6,029,614 A | | 2/2000 | Kayahara et al. | |
| 6,318,305 B1 | * | 11/2001 | Takubo et al. | 122/235.11 |
| 6,558,153 B2 | * | 5/2003 | Schutz et al. | 431/4 |

FOREIGN PATENT DOCUMENTS

JP 07-103411 4/1995

* cited by examiner

*Primary Examiner*—Gregory Wilson
(74) *Attorney, Agent, or Firm*—Birch, Stewart, Kolasch & Birch, LLP

(57) ABSTRACT

Combustion method and apparatus for $NO_x$ reduction are capable of easily achieving $NO_x$ reduction to an exhaust $NO_x$ value of 30 ppm or under. The combustion method is to perform in combination a first $NO_x$ reduction step for suppressing generated $NO_x$ value to 60 ppm or under (at 0% $O_2$ in exhaust gas, dry basis) by a low $NO_x$ burner, a second $NO_x$ reduction step for recirculating exhaust gas of the low $NO_x$ burner to a burning reaction zone formed by the low $NO_x$ burner, and a third $NO_x$ reduction step for adding water or steam to the burning reaction zone.

6 Claims, 6 Drawing Sheets

COMBUSTION METHOD AND APPARATUS FOR $NO_X$ REDUCTION

BACKGROUND OF THE INVENTION

The present invention relates to a combustion method for $NO_x$ reduction, as well as an apparatus therefor, to be applied to water-tube boilers, reheaters of absorption refrigerators, or the like.

Generally, as the principle of suppression of $NO_x$ generation, there have been known (1) suppressing the temperature of flame (combustion gas), (2) reduction of residence time of high-temperature combustion gas, and (3) lowering the oxygen partial pressure. Then, various $NO_x$ reduction techniques to which these principles are applied are available. Examples that have been proposed and developed into practical use include the two-stage combustion method, the thick and thin fuel combustion method, the exhaust gas recirculate combustion method, the water addition combustion method, the steam jet combustion method, the flame cooling combustion method with water-tube groups (water-tube cooling combustion method), and the like.

With respect to small-size once-through boilers, as of today, there has been laid out in Tokyo Metropolis or others a regulation that the exhaust $NO_x$ value of gas-fired boilers should be not more than 60 ppm (at 0% $O_2$ in the exhaust gas, dry basis; hereinbelow, the unit ppm is expressed at 0% $O_2$ in the exhaust gas, dry basis, unless otherwise specified), and that the exhaust $NO_x$ value of oil-fired boilers should be not more than 80 ppm for A-type heavy oil and not more than 60 ppm for kerosine. Many manufacturers including the present applicant have cleared these regulation values. However, California in U.S.A. has already laid out a regulation specifying not more than 12 ppm (at 3% $O_2$ in the exhaust gas, dry basis). The applicant, envisaging that even stricter regulations, e.g. not more than 30 ppm, will be applied in the near future also in Japan, has been performing research and development for further $NO_x$ reduction.

A prior-art $NO_x$ reduction techniques is proposed in combinations of above-described various suppression principles (see, e.g., Patent Reference 1: Japanese Published Patent Application H07-103411, Page 3, FIG. 1). This prior-art technique is a combination of the exhaust gas recirculate technique and the steam jet. However, with this $NO_x$ reduction technique, it is not easy to achieve an exhaust $NO_x$ value of not more than 30 ppm (hereinafter, referred to as "target exhaust $NO_x$ value").

That is, the present inventors of this application have found through various experiments and discussions that the following issues exist in order to achieve the target exhaust $NO_x$ value or lower in the prior art.

First, in the prior art, for reduction of the $NO_x$ value by a functional enhancement of combustion gas temperature suppression with the exhaust gas recirculation, the functional enhancement is to increase the exhaust-gas recirculation quantity. However, implementing this functional enhancement would cause unstable characteristics of the exhaust gas recirculation to be amplified. That is, the exhaust gas recirculation has a characteristic that the exhaust-gas flow rate or temperature changes with changes in combustion quantity or changes in load. An increase in the exhaust-gas recirculation quantity would cause these unstable characteristics to be amplified, making it impossible to achieve a stable $NO_x$ reduction. Also, an increase in the exhaust-gas recirculation quantity would cause the oxygen concentration in the combustion air to lower, resulting in a combustion state of oxygen deficiency, so that the combustion could no longer be continued because of incomplete combustion or discharge of unburned combustibles. Further, a volume increase corresponding to the exhaust-gas recirculation quantity would cause the pressure loss in the air blow passage to increase, thus making it inevitable to increase the cost due to the increase in the blower capacity.

Also, a functional enhancement of $NO_x$ reduction by steam addition is to increase the quantity of water to be added. This functional enhancement would cause an increase in thermal loss and moreover an increase in the quantity of condensations, posing a problem of corrosion of the constituent equipment due to the condensations.

SUMMARY OF THE INVENTION

An object of the present invention is to provide a combustion method for $NO_x$ reduction, as well as an apparatus therefor, capable of solving these and other issues and easily achieving $NO_x$ reduction with the value of exhaust $NO_x$ under 30 ppm.

The present invention having been accomplished to solve the above object, in a first aspect of the invention, there is provided a combustion method for $NO_x$ reduction comprising in combination the steps of: a first $NO_x$ reduction step for suppressing generated $NO_x$ value to 60 ppm or under (at 0% $O_2$ in exhaust gas, dry basis) by a low $NO_x$ burner; a second $NO_x$ reduction step for recirculating exhaust gas of the low $NO_x$ burner to a burning reaction zone formed by the low $NO_x$ burner; and a third $NO_x$ reduction step for adding water or steam to the burning reaction zone.

In a second aspect of the invention, there is provided a combustion method for $NO_x$ reduction as described in the first aspect, wherein the second $NO_x$ reduction step is performed with a target exhaust $NO_x$ value set to 30 ppm or under (at 0% $O_2$ in exhaust gas, dry basis) and with an exhaust-gas recirculation quantity set in a stable combustion range of the low $NO_x$ burner, and any $NO_x$ value exceeding the target exhaust $NO_x$ value is reduced by the third $NO_x$ reduction step.

In a third aspect of the invention, there is provided a combustion method for $NO_x$ reduction as described in the first or second aspect, wherein the third $NO_x$ reduction step is performed by spraying water directly to the burning reaction zone.

In a fourth aspect of the invention, there is provided a combustion apparatus for $NO_x$ reduction, comprising: a low $NO_x$ burner for suppressing generated $NO_x$ value to 60 ppm or under (at 0% $O_2$ in exhaust gas, dry basis); exhaust gas recirculation means for recirculating exhaust gas of the low $NO_x$ burner to a burning reaction zone formed by the low $NO_x$ burner; and water or steam addition means for adding water or steam to the burning reaction zone.

Further, in a fifth aspect of the invention, there is provided a combustion apparatus for $NO_x$ reduction, comprising: a low $NO_x$ burner for suppressing generated $NO_x$ value to 60 ppm or under (at 0% $O_2$ in exhaust gas, dry basis); exhaust gas recirculation means for recirculating exhaust gas of the low $NO_x$ burner to a burning reaction zone formed by the low $NO_x$ burner; and water spraying means for spraying water directly to the burning reaction zone.

In one embodiment, there is provided a $NO_x$ reduction combustion method as described in any one of the first to third aspects, wherein the $NO_x$ reduction step is performed with an excess air ratio which is determined from a $NO_x$ reduction target value and an excess air ratio versus $NO_x$ characteristic of the $NO_x$ reduction step.

Before the description of embodiments of the present invention, terms used herein are explained. The combustion gas includes burning-reaction ongoing (under-combustion-process) combustion gas, and combustion gas that has completed burning reaction. Then, the burning-reaction ongoing gas refers to combustion gas that is under burning reaction, and the burning-completed gas refers to combustion gas that has completely burning-reacted. The burning-reaction ongoing gas is indeed a concept of substance, but can also be referred to as flame as a concept of state because it generally includes a visible flame so as to be in a flame state. Therefore, herein, the burning-reaction ongoing gas is referred to also as flame or burning flame from time to time. Further, the burning reaction zone refers to a zone where the burning-reaction ongoing gas is present, and the exhaust gas refers to burning-completed gas that has decreased in temperature under an effect of endothermic action by heat transfer tubes or the like.

Also, the combustion gas temperature, unless otherwise specified, means the temperature of burning-reaction ongoing gas, equivalent to combustion temperature or combustion flame temperature. Further, the suppression of combustion gas temperature refers to suppressing the maximum value of combustion gas (combustion flame) temperature to a low one. In addition, normally, burning reaction is continuing although in a trace amount even in the burning-completed gas, and so the combustion completion does not mean a 100% completion of burning reaction. The target exhaust $NO_x$ value refers to a target value for the $NO_x$ value exhausted from the $NO_x$ reduction combustion apparatus.

Next, embodiments of the present invention are described. The present invention is applied to thermal equipment (or combustion equipment) such as small-size once-through boilers or other water-tube boilers, water heaters, reheaters of absorption refrigerators or the like. The thermal equipment has a burner and a group of heat absorbers to be heated by combustion gas derived from the burner.

An embodiment of the method according to the present invention is a combustion method for $NO_x$ reduction comprising in combination the steps of: a first $NO_x$ reduction step for suppressing generated $NO_x$ value to 60 ppm or under, preferably 50 ppm or under, by a low $NO_x$ burner; a second $NO_x$ reduction step for recirculating exhaust gas of the low $NO_x$ burner to a burning reaction zone formed by the low $NO_x$ burner; and a third $NO_x$ reduction step for adding water or steam to the burning reaction zone. Means for performing the first $NO_x$ reduction step, means for performing the second $NO_x$ reduction step, and means for performing the third $NO_x$ reduction step are referred to as first $NO_x$ reduction means, second $NO_x$ reduction means, and third $NO_x$ reduction means, respectively.

The first $NO_x$ reduction means is the low $NO_x$ burner. The low $NO_x$ burner may be implemented by a burner that suppresses the generated $NO_x$ value to 60 ppm or under by using any one or combining any ones from among the divided flame combustion method, the self recirculate method, the staged combustion method, the thick and thin fuel combustion method, and other techniques. The low $NO_x$ burner is preferably given by a gas-fired burner, but may also be an oil-fired burner in another embodiment.

Then, burning reaction is performed in front of the low $NO_x$ burner, by which a burning reaction zone is formed.

The second $NO_x$ reduction means is what is called exhaust gas recirculation method, in which part of exhaust gas to be discharged into the atmospheric air after having decreased in temperature under an effect of endothermic action by the heat absorbers is mixed into the combustion air by external recirculation via an exhaust-gas recirculation passage, which is an external passage. By a combustion-gas-temperature suppression effect or a decrease in oxygen concentration or the like attributable to this mixed exhaust gas, the $NO_x$ value is reduced.

The exhaust-gas recirculation quantity by the second $NO_x$ reduction means is set to within the stable combustion range of the low $NO_x$ burner. The stable combustion range refers to a range in which the exhaust CO amount is 100 ppm or under, preferably 50 ppm or under.

The third $NO_x$ reduction means is water or steam addition to the burning reaction zone. By this water or steam addition, the burning-reaction ongoing gas is cooled so that the combustion gas temperature is suppressed, thus the $NO_x$ value being reduced.

The water or steam addition is performed, preferably, by spraying water directly toward the burning reaction zone. By doing so, in an embodiment in which gaseous mixture of combustion air and exhaust gas is blown to the low $NO_x$ burner by a blower, it becomes implementable to prevent the blower from corrosion and to fulfill the $NO_x$ reduction while suppressing the increase in the capacity of the blower to a minimum.

Otherwise, the water or steam addition by the third $NO_x$ reduction means may be done in the exhaust-gas recirculation passage in another embodiment. Furthermore, in an embodiment in which the gaseous mixture of combustion air and exhaust gas is fed to the low $NO_x$ burner by a blower, steam addition may be performed between the low $NO_x$ burner and the blower.

In the combustion method for $NO_x$ reduction of this embodiment, the target exhaust $NO_x$ value is set to 30 ppm or under, preferably 20 ppm or under. Then, the generated $NO_x$ value by the first $NO_x$ reduction means is set to 60 ppm or under, preferably 50 ppm or under, and subsequently a $NO_x$ reduction is performed by the second $NO_x$ reduction means.

With this arrangement, given that the generated $NO_x$ value by the first $NO_x$ reduction means is A, the $NO_x$ reduction value by the second $NO_x$ reduction means is B and the target exhaust $NO_x$ value is X, then it is assumed that the third $NO_x$ reduction means fulfills a $NO_x$ value of $A-B-X=C$. That is, setting the $NO_x$ reduction value by the third $NO_x$ reduction means to C or more makes it possible to achieve the target exhaust $NO_x$ value or under.

By this method as described above, there can be produced an effect that the target exhaust $NO_x$ value or under can be achieved without incurring the aforementioned issues of the exhaust gas recirculation, and moreover such problems as the corrosion of the equipment can be avoided and further the increase in the blower capacity can be suppressed to a minimum.

Also, in the foregoing embodiment, preferably, a combustion space where the heat transfer tubes are not present, i.e. the heat transfer tubes have been eliminated, is formed in front of the low $NO_x$ burner, so that the burning reaction is performed in the combustion space, with a burning reaction zone formed there. Desirably, the combustion space has such an area that burning reaction of the fuel jetted out from the low $NO_x$ burner is completed within the zone, but this is not limitative.

That a combustion space where the heat transfer tubes are not present is formed in front of the low $NO_x$ burner means that the water-tube cooling combustion method is not aggressively performed. As a result of this, it is no longer necessary to take measures for the issues of the water-tube cooling combustion method, i.e., the emission of large amounts of CO or unburned combustibles due to the burning-reaction suppression effect of the water tubes. In particular, the $NO_x$ reduction technique by the water-tube cooling combustion method has an issue that the combustion itself cannot be continued in applications to combustion apparatus using an oil-fired burner, and therefore it is preferable to form in front of the low $NO_x$ burner a combustion space where the heat transfer tubes are not present.

Further, in the foregoing embodiment, preferably, the water or steam addition is performed by spraying water directly toward the burning reaction zone within the combustion space. By doing so, a stable suppression of the combustion gas temperature is fulfilled. Also, in the embodiment in which the gaseous mixture of combustion air and exhaust gas is blown to the low $NO_x$ burner by a blower, it becomes implementable to prevent the blower from corrosion and moreover to prevent the blower from increasing in load.

Next, embodiments of the apparatus according to the present invention are described. The present invention includes the following embodiments (1) to (5) of the apparatus corresponding to the foregoing embodiments of the method.

Embodiment (1): A combustion apparatus for $NO_x$ reduction comprising: a low $NO_x$ burner for suppressing generated $NO_x$ value to 60 ppm or under (at 0% $O_2$ in exhaust gas, dry basis); exhaust gas recirculation means for recirculating exhaust gas of the low $NO_x$ burner to a burning reaction zone formed by the low $NO_x$ burner; and water or steam addition means for adding water or steam to the burning reaction zone.

Embodiment (2): A combustion apparatus for $NO_x$ reduction as defined in Embodiment (1), wherein with a target exhaust $NO_x$ value of 30 ppm, the target exhaust $NO_x$ value is fulfilled by $NO_x$ reduction effects by the exhaust gas recirculation means and the water or steam addition means.

Embodiment (3): A combustion apparatus for $NO_x$ reduction comprising: a low $NO_x$ burner for suppressing generated $NO_x$ value to 60 ppm or under (at 0% $O_2$ in exhaust gas, dry basis); exhaust gas recirculation means for recirculating exhaust gas of the low $NO_x$ burner to a burning reaction zone formed by the low $NO_x$ burner; and water spraying means for spraying water directly to the burning reaction zone.

Embodiment (4): A combustion apparatus for $NO_x$ reduction, wherein a combustion space where the heat transfer tubes have been eliminated is formed in front of the low $NO_x$ burner.

Embodiment (5): A combustion apparatus for $NO_x$ reduction comprising: a low $NO_x$ burner for suppressing generated $NO_x$ value to 60 ppm or under (at 0% $O_2$ in exhaust gas, dry basis), the low $NO_x$ burner being switchable between low combustion and high combustion; exhaust gas recirculation means for recirculating exhaust gas of the low $NO_x$ burner to a burning reaction zone formed by the low $NO_x$ burner in low combustion and high combustion of the low $NO_x$ burner; and water or steam addition means for adding water or steam to the burning reaction zone only in the high combustion of the low $NO_x$ burner.

DETAILED DESCRIPTION OF THE PREFERRED EMBODIMENTS

Figure 1:
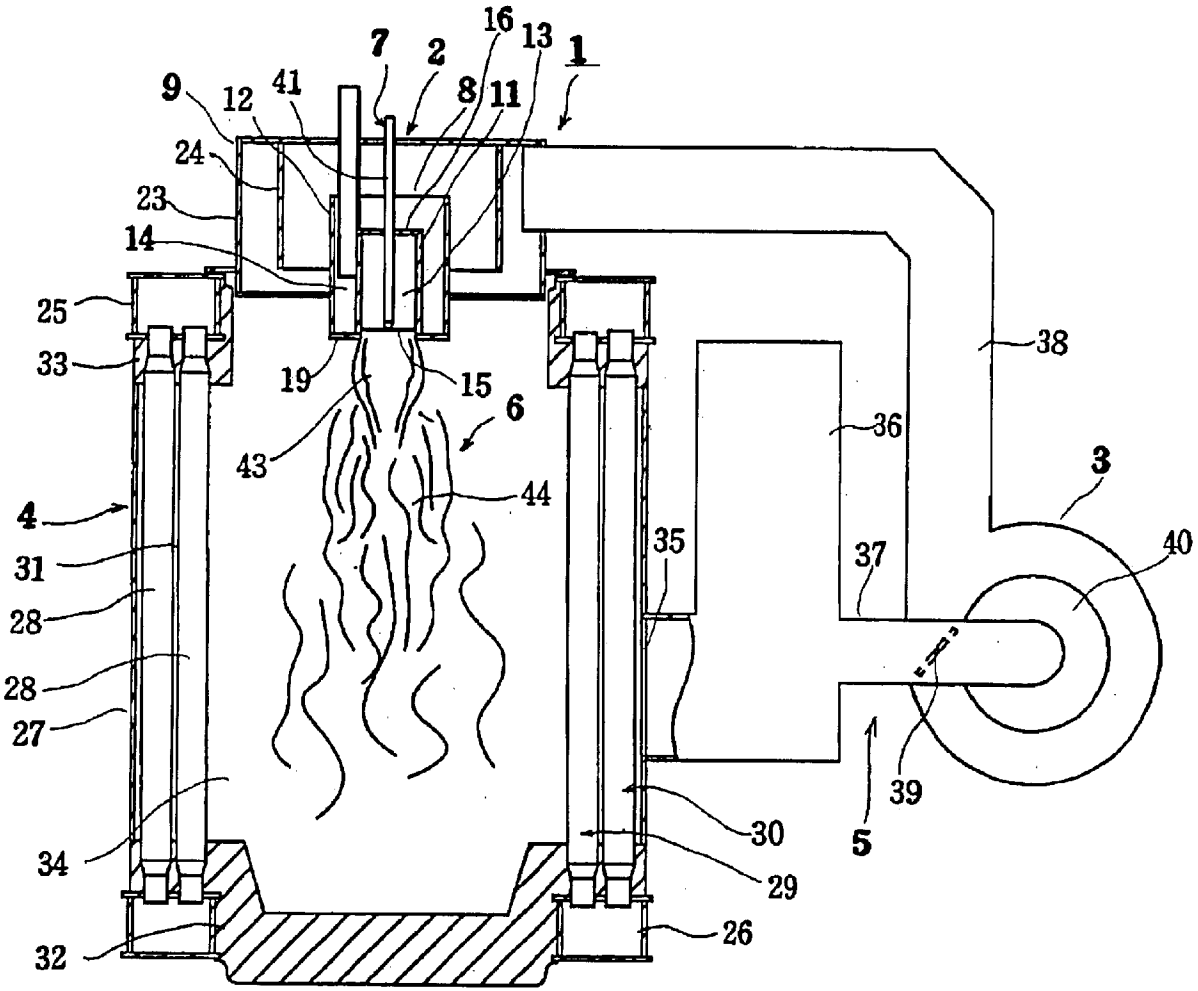
FIG. 1 is an explanatory view of a longitudinal section of a steam boiler to which an embodiment of the present invention is applied.
Figure 4:
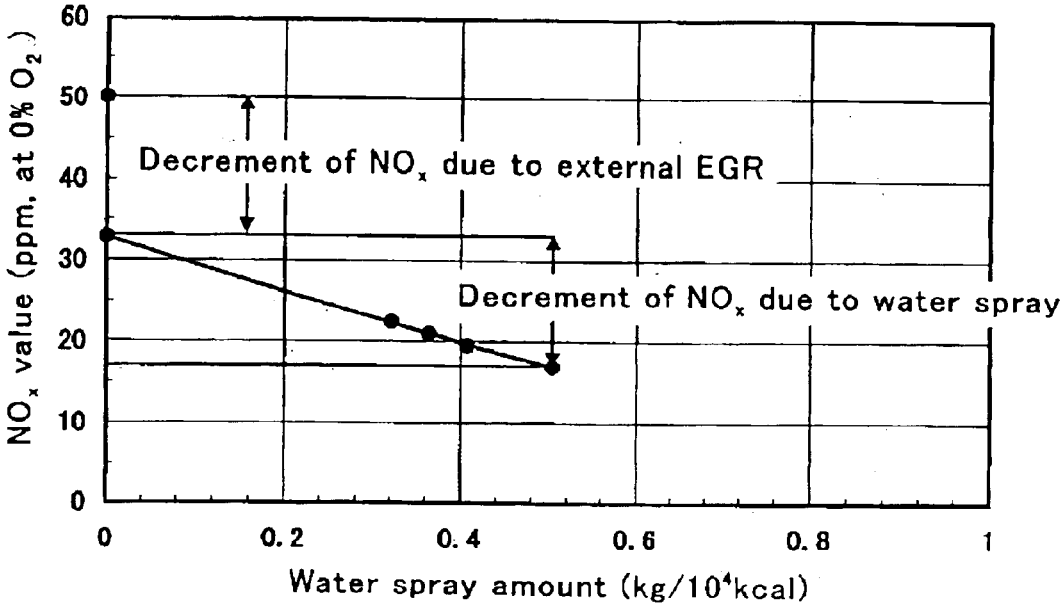
FIG. 4 is a chart showing a $NO_x$ reduction characteristic relative to water spray quantity in the same embodiment.
Figure 5:
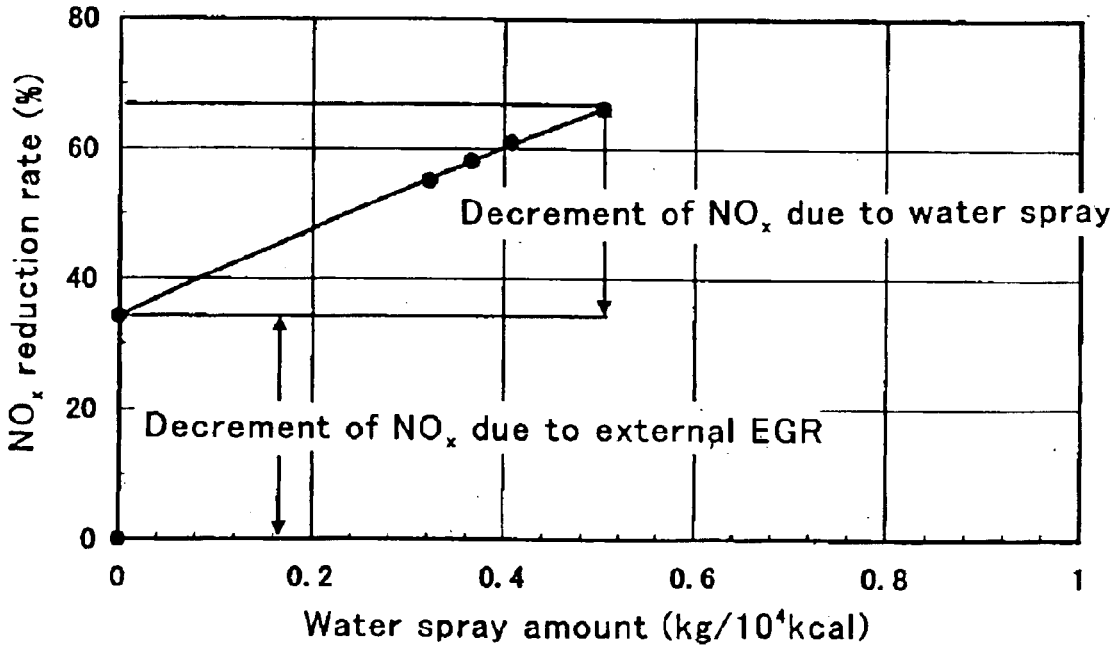
FIG. 5 is a chart showing a $NO_x$ reduction rate characteristic relative to water spray quantity in the same embodiment.
Figure 6:
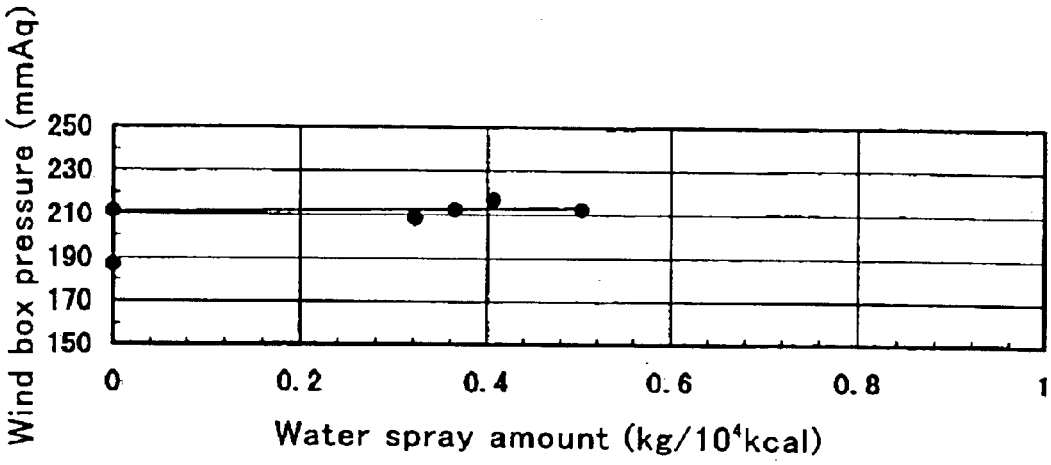
FIG. 6 is a chart showing a wind box pressure characteristic relative to water spray quantity.

Hereinbelow, working examples in which the $NO_x$ reduction combustion method and apparatus of the present invention are applied to a once-through steam boiler, which is one type of water-tube boilers, are described in accordance with the accompanying drawings. FIG. 1 is an explanatory view of a longitudinal section of a steam boiler to which an embodiment of the present invention is applied, FIG. 2 is an enlarged sectional view of a main part of FIG. 1, FIG. 3 is an explanatory view of a bottom face of the main part of FIG. 2, FIG. 4 is a chart showing a $NO_x$ reduction characteristic relative to water spray quantity in the same embodiment, FIG. 5 is a chart showing a $NO_x$ reduction rate characteristic relative to water spray quantity in the same embodiment, and FIG. 6 is a chart showing a wind box pressure characteristic relative to water spray quantity.

Referring to FIG. 1, a steam boiler 1, which is the $NO_x$ reduction combustion apparatus of this working example, is a boiler having a target exhaust $NO_x$ value of 20 ppm and comprising: a low $NO_x$ burner 2; a blower 3 for blowing combustion air to the burner 2; an annular-shaped boiler body 4 to the top-face opening of which the low $NO_x$ burner 2 is to be fitted; an exhaust gas recirculation means 5 for mixing, and thereby feeding, part of exhaust gas discharged from the boiler body 4 into the combustion air for the low $NO_x$ burner 2; and a water spray means 7 for spraying water to a burning reaction zone 6 formed by the low $NO_x$ burner 2.

The low $NO_x$ burner 2 performs the thick and thin fuel combustion method, the self recirculate combustion method and the two-stage combustion method in combination, by which the value of generated $NO_x$ in a state in which neither the exhaust gas recirculation nor the water spray is performed is set to about 50 ppm. This low $NO_x$ burner 2 is composed of a burner body 8, and a wind box 9 for introducing combustion air to the burner body 8.

Figure 2:
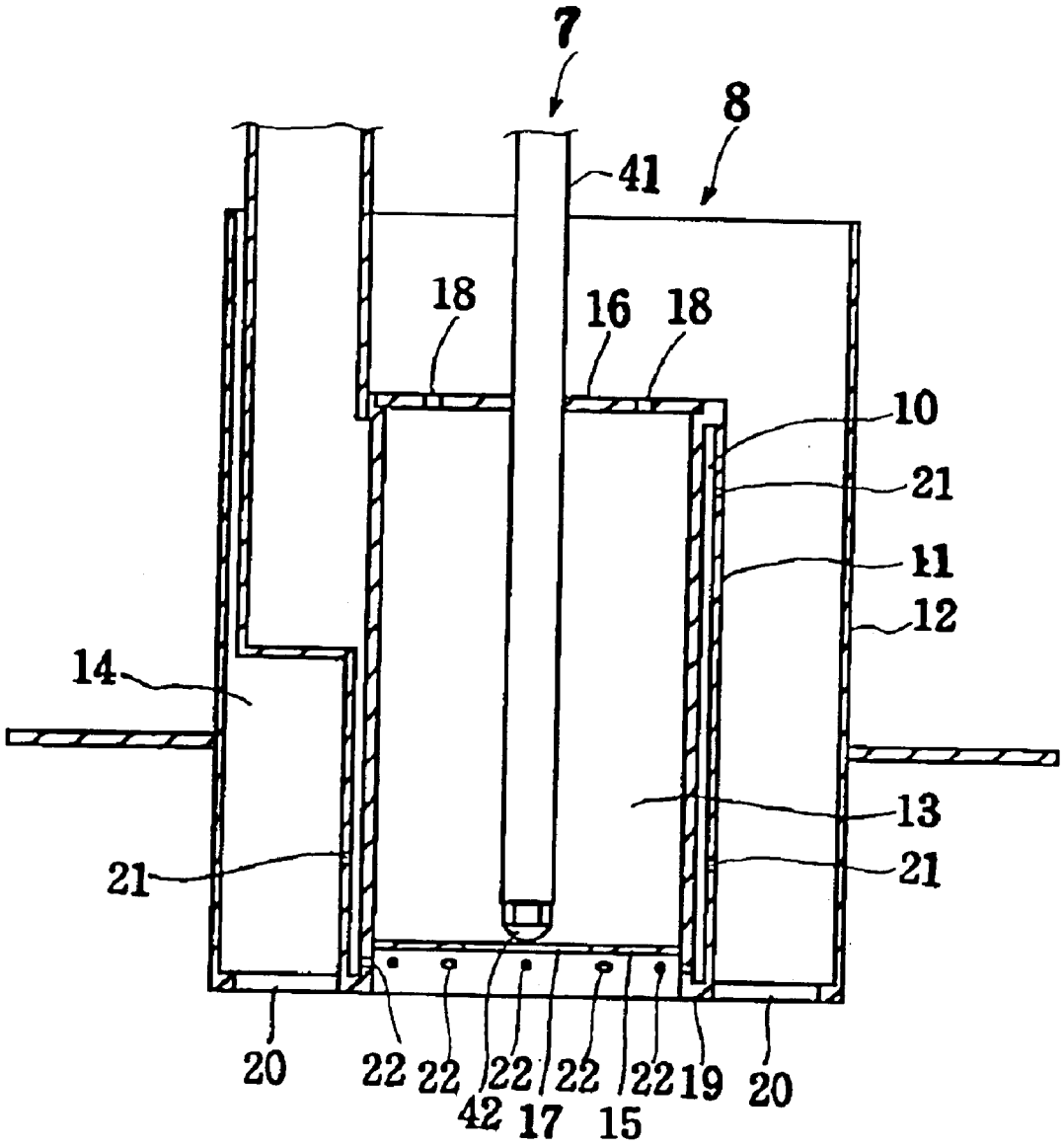
FIG. 2 is an enlarged sectional explanatory view of a main part of FIG. 1.
Figure 3:
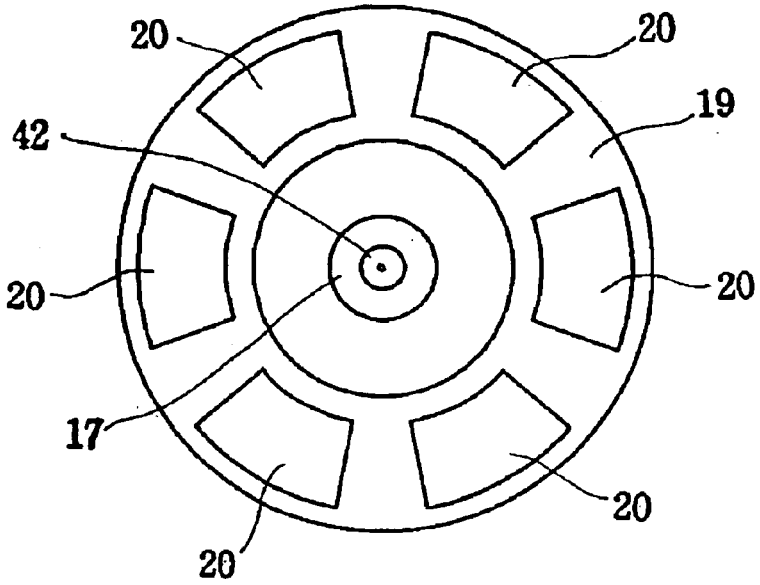
FIG. 3 is an explanatory view of a bottom face of the main part of FIG. 2.

The burner body 8, as shown in FIGS. 2 and 3, includes a generally annular-shaped-in-section fuel passage member 11 whose interior is a gas fuel passage 10, and a cylindrical-shaped air register 12 disposed outside the fuel passage member 11 coaxially. Then, inside the fuel passage member 11 is a primary air passage 13 through which primary air passes, and between the fuel passage member 11 and the air register 12 is a secondary air passage 14.

Combustion air for the primary air passage 13 and the secondary air passage 14 is supplied by the blower 3. In this working example, the proportions of primary air and secondary air are set to 10 to 20% of primary air and 90 to 80% of secondary air.

Further, a first baffle plate 15 is provided at a position slightly deeper than the lower end of the primary air passage 13 so as to cover the lower-end opening, and a second baffle plate 16 is provided at an upper end of the primary air passage 13 so as to cover the upper-end opening. The first baffle plate 15 has a first opening 17 at a center, and the second baffle plate 16 has a plurality of small-diameter second openings 18, 18, . . . through which primary air passes.

The secondary air passage 14 also has an annular-shaped third baffle plate 19. This third baffle plate 19, as shown in FIG. 3, has six cut-outs 20, 20, . . . arranged circumferentially at generally equal intervals. By these cut-outs 20, secondary air is dividedly fed (flow rate: 30 to 50 m/s), by which divided flames are formed.

Further, in the fuel passage member 11 are provided outer jet holes 21, 21, . . . for jetting gas fuel outward, and inner jet holes 22, 22, . . . positioned at lower end portions and serving for jetting gas fuel inward. These outer jet holes 21 and inner jet holes 22 are provided circumferentially in plural numbers as shown in the figure, and the total opening area of the outer jet holes 21, 21, . . . is set larger than the total opening area of the inner jet holes 22, 22, . . . . The inner jet holes 22 are formed downstream of the first baffle plate 15.

Next, the wind box 9 is explained. Referring to FIG. 1, the wind box 9 functions to guide the combustion air blown by the blower 3 to the low $NO_x$ burner 2, and is composed of an outer cylindrical member 23 closed at its upper and lower ends and a lower-end opened inner cylindrical member 24 placed coaxial therewith.

Next, the boiler body 4 is explained. Referring to FIG. 1, the boiler body 4 is described in detail in U.S. Pat. No. 6,269,782(Japanese Published Patent Application 2001-41401), the disclosure of which is hereby incorporated by reference. The boiler body 4 has an upper header 25 and a lower header 26 spaced from each other at a specified distance. Between outer circumferences of these upper header 25 and lower header 26 is disposed an outer wall 27.

Between the upper header 25 and the lower header 26, a plurality of water tubes 28, 28, . . . are arranged in a double annular shape. These water tubes 28, 28, . . . constitute annular-shaped inner first water wall 29 and outer second water wall 30, with an annular-shaped exhaust gas passage 31 defined between these water walls 29, 30. Then, a first outlet (not shown) for combustion gas that has nearly completed burning reaction is formed at a portion of the first water wall 29, and a second outlet (not shown) for exhaust gas given by not providing the water tube is formed in the second water wall 30 opposite the first outlet (generally point-symmetrically). Reference numerals 32, 33 denote refractory members.

Then, a space which is surrounded by the upper header 25, the lower header 26, the first water wall 29 and the like and in which the water tubes 28 are not present is assigned as a combustion space 34 where an air-fuel mixture of the fuel jetted out from the low $NO_x$ burner 2 and combustion air is burned to form the burning reaction zone 6. The upper header 25 is fitted with the low $NO_x$ burner 2, so that the combustion space 6 is formed in front of this burner 2. The low $NO_x$ burner 2 is inserted from an inward (central portion) of the upper header 25 toward the combustion space 34, so that the combustion-gas jet direction of the low $NO_x$ burner 2 and the water tubes 28 of the first water wall 29 are generally parallel to each other.

Further, in the annular-shaped outer wall 27 provided outside the second water wall 30, an exhaust-gas outlet 35 is provided at a position confronting the second outlet so as to communicate with the exhaust gas passage 31. A smokestack 36 is connected to this exhaust-gas outlet 35.

Next, the exhaust gas recirculation means 5 is explained. This exhaust gas recirculation means 5 makes part of the exhaust gas discharged from the boiler body 4 mixed into the combustion air of the low $NO_x$ burner 2 to suppress the combustion gas temperature and thereby reduce $NO_x$.

The exhaust gas recirculation means 5 is composed of a first duct 37 branched from the smokestack 36 and connected to an inlet port (not shown) of the blower 3, the blower 3, and a second duct 38 that connects a discharge port (not shown) of the blower 3 and the wind box 9 to each other. In the first duct 37 is provided an adjustment damper 39 that can adjust the exhaust gas recirculation rate. Reference numeral 40 denotes a cylindrical-shaped lid member to which the first duct 37 is connected and which is fitted to the inlet port so as to cover it, and fresh air inlets (not shown) composed of a multiplicity of small holes are formed on its peripheral surface. These fresh air inlets may also be formed in a surface of the lid member 40 to which the first duct 37 is connected (a surface indicated by numeral 40 in FIG. 1).

In this working example, the exhaust-gas recirculation rate by the exhaust gas recirculation means 5 is set to 6%. This value is set by taking into consideration such a range that the blowing performance of the blower 3 is not exceeded and that a stable combustion is ensured (aforementioned stable combustion range).

Finally, the water spray means 7 is explained. This water spray means 7, as shown in FIGS. 1 and 2, is implemented by a water spray tube 41 which is disposed at a generally center of the primary air passage 13 so that its forward end confronts the first opening 17 of the first baffle plate 15. The water spray means 7 is so constructed that water mist is jetted out from a nozzle 42 provided at the forward end of the water spray tube 41 toward the burning reaction zone 6 formed in the combustion space 34 through the first opening 17.

The amount of water addition by the water spray means 7 is determined in following manner. As already described, the value of generated $NO_x$ of the low $NO_x$ burner 2 is 50 ppm and the value of $NO_x$ reduction by the exhaust gas recirculation means 5 is 17 to 18 ppm. Since the target exhaust $NO_x$ value of the steam boiler 1 has been set to 20 ppm, the value of $NO_x$ that has to be reduced by the water spray means 7 is 12 to 13 ppm. A spray amount corresponding to this $NO_x$ reduction value is determined from the characteristic view shown in FIG. 4, resulting in 0.4 kg/$10^4$ kcal. It is noted that the gas fuel in FIG. 4 is a natural gas.

Now, operation of the working example constituted as described above is explained. When the low $NO_x$ burner 2 and the like are actuated, gas fuel is jetted out from the outer jet holes 21 and the inner jet holes 22. The gas fuel jetted out from the inner jet holes 22 is mixed with primary air flowing through the primary air passage 13, by which a small flame as a first burning reaction zone 43 is formed at a position downstream of the first baffle plate 15. This small flame acts as a pilot burner, enhancing the flame holdability.

The gas fuel jetted out from the outer jet holes 21 is mixed with secondary air flowing through the secondary air passage 14, by which a large flame as a second burning reaction zone 44 is formed at a position downstream of the third baffle plate 19. Since the secondary air is divided by the third baffle plate 19 and fed as such, divided flames are formed. Also, a thick and thin fuel combustion is performed with the small flame in a thick fuel combustion of an about 0.7 air ratio and with the large flame in a thin fuel combustion of an about 1.6 air ratio. Thus, in the low $NO_x$ burner 2 of this working example, its generated $NO_x$ is suppressed to 50 ppm in the state that neither the exhaust gas recirculation nor the water spray is performed, by virtue of the flame division method and thick and thin fuel combustion.

The low $NO_x$ burner 2 forms the burning reaction zone 6. The burning reaction zone 6 is composed of the first burning reaction zone 43 where a thick (fuel-rich) fuel-air mixture is burned, and the second burning reaction zone 44 where a thin (air-rich) fuel-air mixture is burned. The first burning reaction zone 43 functions as a flame holding zone as described above.

Further, by virtue of the arrangement that the exhaust gas recirculation rate by the exhaust gas recirculation means 5 is set to 6%, a $NO_x$ reduction of about 17 to 18 ppm is achieved by combustion-gas temperature suppression of the second burning reaction zone 44 or the like (see FIG. 4).

Further, water mist jetted out from the water spray tube 41 reaches the second burning reaction zone 44 to suppress the combustion gas temperature of the second burning reaction zone 44, by which the $NO_x$ value is further lowered by about 12 to 13 ppm so that the exhaust $NO_x$ value becomes not more than the target exhaust $NO_x$ value (see FIG. 4).

The $NO_x$ reduction effect in this working example is as shown in FIG. 4 as described before, and further, when expressed in conversion to $NO_x$ reduction rate, results in a characteristic as shown in FIG. 5. These figures show that changing the amount of water spray causes the $NO_x$ reduction value to increase in proportion to the amount. Also, FIG. 6 shows that there are almost no pressure fluctuations inside the wind box 9 due to increases or decreases in the amount of water spray. This means that the water spray in this working example does not adversely affect the combustibility.

Here is explained the flow of combustion gas. Heat is transferred to the first water wall 29 by radiant heat transfer in the combustion space 34, and combustion gas that has nearly completed burning reaction flows via the first outlet into the exhaust gas passage 31, where convective heat transfer with the first water wall 29 and the second water wall 30 is performed. Then, the exhaust gas, passing through the second outlet, the exhaust-gas outlet 35 and the smokestack 36, is discharged into the atmospheric air while part of the exhaust gas is utilized by the exhaust gas recirculation means 5. The part of the exhaust gas is mixed with the combustion air fed to the low $NO_x$ burner 2 by the blower 3.

According to this working example, the following working effects are produced. By virtue of the combination of the $NO_x$ reduction by the low $NO_x$ burner 2, the $NO_x$ reduction by the exhaust gas recirculation means 5 and the $NO_x$ reduction by the water spray means 7, it becomes possible to clear the target exhaust $NO_x$ value of 20 ppm over the range of the blowing performance of the blower 3 and without incurring unstable combustion of the low $NO_x$ burner 2, even without the use of the water-tubes cooling combustion.

Further, since the water spray by the water spray means 7 is done directly to the burning reaction zone 6, the target exhaust $NO_x$ value or lower can be achieved without increasing the load of the blower 3.

According to the present invention, for example, a $NO_x$ reduction with the exhaust $NO_x$ value under 30 ppm can be easily fulfilled, hence great industrial value.

What is claimed is:

1. A combustion method for $NO_x$ reduction, comprising in combination the steps of:

a first $NO_x$ reduction step for suppressing generated $NO_x$ value to 60 ppm or under (at 0% $O_2$ in exhaust gas, dry basis) by a low $NO_x$ burner;

a second $NO_x$ reduction step for recirculating exhaust gas of the low $NO_x$ burner to a burning reaction zone formed by the low $NO_x$ burner; and a third $NO_x$ reduction step for adding water or steam to the burning reaction zone.

2. A combustion method for $NO_x$ reduction as claimed in claim 1, wherein the third $NO_x$ reduction step is performed by spraying water directly to the burning reaction zone.

3. A combustion method for $NO_x$ reduction as claimed in claim 1, wherein the second $NO_x$ reduction step is performed with a target exhaust $NO_x$ value set to 30 ppm or under (at 0% $O_2$ in exhaust gas, dry basis) and with an exhaust-gas recirculation quantity set in a stable combustion range of the low $NO_x$ burner, and any $NO_x$ value exceeding the target exhaust $NO_x$ value is reduced by the third $NO_x$ reduction step.

4. A combustion method for $NO_x$ reduction as claimed in claim 3, wherein the third $NO_x$ reduction step is performed by spraying water directly to the burning reaction zone.

5. A combustion apparatus for $NO_x$ reduction, comprising:

a low $NO_x$ burner for suppressing generated $NO_x$ value to 60 ppm or under (at 0% $O_2$ in exhaust gas, dry basis);

exhaust gas recirculation means for recirculating exhaust gas of the low $NO_x$ burner to a burning reaction zone formed by the low $NO_x$ burner; and water or steam addition means for adding water or steam to the burning reaction zone.

6. A combustion apparatus for $NO_x$ reduction, comprising:

a low $NO_x$ burner for suppressing generated $NO_x$ value to 60 ppm or under (at 0% $O_2$ in exhaust gas, dry basis);

exhaust gas recirculation means for recirculating exhaust gas of the low $NO_x$ burner to a burning reaction zone formed by the low $NO_x$ burner; and water spraying means for spraying water directly to the burning reaction zone.

* * * * *